US006658984B2

(12) United States Patent
Zonak

(10) Patent No.: US 6,658,984 B2
(45) Date of Patent: Dec. 9, 2003

(54) ANTI-MINE FLOOR FOR AN ARMORED VEHICLE

(75) Inventor: Armin Zonak, Kiel (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 0 days.

(21) Appl. No.: 10/193,147

(22) Filed: Jul. 12, 2002

(65) Prior Publication Data

US 2003/0010189 A1 Jan. 16, 2003

(30) Foreign Application Priority Data

Jul. 14, 2001 (DE) ..... 101 34 394

(51) Int. Cl.[7] ..... F41H 7/04
(52) U.S. Cl. ..... 89/36.08; 89/36.02
(58) Field of Search ..... 89/36.07, 36.08, 89/36.09, 40.01, 40.03, 36.02

(56) References Cited

U.S. PATENT DOCUMENTS

| | | | | |
|---|---|---|---|---|
| 1,136,605 | A | * | 4/1915 | Lobato |
| 1,149,127 | A | * | 8/1915 | Giem |
| 2,382,862 | A | * | 8/1945 | Davis, Jr. |
| 4,362,083 | A | * | 12/1982 | Straub |
| 4,492,282 | A | * | 1/1985 | Appelblatt et al. ..... 180/68.1 |

FOREIGN PATENT DOCUMENTS

| | | | | |
|---|---|---|---|---|
| DE | 32 06 794 | A1 | | 9/1983 ..... 89/36.08 |
| DE | 36 27 485 | A1 | * | 2/1988 |
| DE | 196 43 757 | A1 | | 4/1997 |
| DE | 19631715 | A1 | | 2/1998 |
| DE | 196 53 283 | C1 | | 6/1998 |
| DE | 199 13 845 | A1 | | 9/2000 |
| DE | 199 35 573 | A 1 | | 2/2001 |
| DE | 199 58 594 | A1 | | 6/2001 |
| EP | 0 828 134 | A | | 3/1998 |
| EP | 0849560 | A2 | | 6/1998 |
| EP | 1081452 | A2 | | 3/2001 |
| FR | 1 119 078 | | * | 6/1956 |
| FR | 1 259 068 | | * | 12/1961 |
| FR | 2 453 385 | A | | 10/1980 |
| GB | 476 717 | A | | 12/1937 |
| GB | 2 052 695 | A | * | 1/1981 |
| GB | 2 071 829 | A | * | 9/1981 |
| IT | 336 386 | | * | 12/1936 |
| IT | 514 088 | | * | 8/1956 |

* cited by examiner

*Primary Examiner*—Stephen M. Johnson
(74) *Attorney, Agent, or Firm*—Venable LLP; Norman N. Kunitz

(57) ABSTRACT

An apparatus for providing anti-mine protection for an armored vehicle, the apparatus comprising a concave floor plate (1) that provides both a sufficient ground clearance (3) and a clear distance (14) between the floor plate and spring bars or support arms mounted above the floor plate. The floor plate (11) is fixedly connected on the sides to the housing or hull side wall (8, 8') and the side flange plate (4) secured to the housing side wall, such that respective angled regions of the housing side wall (6) and of the flange plates (9) surround the top and bottom of the floor plate (1) and rest flat against it.

16 Claims, 3 Drawing Sheets

Fig.2
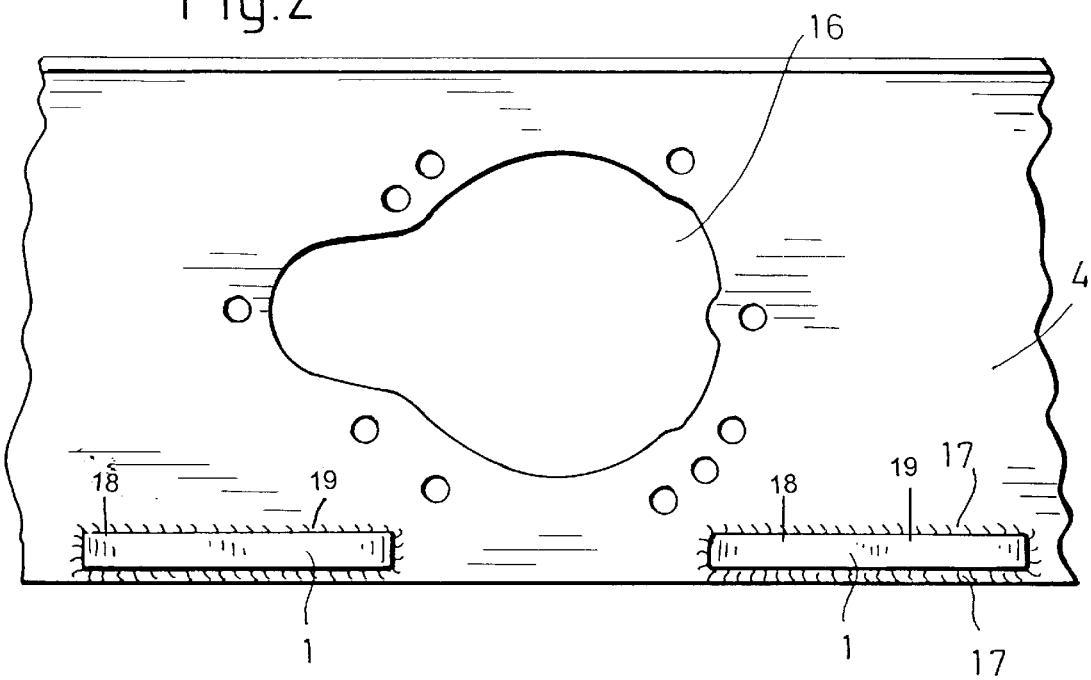
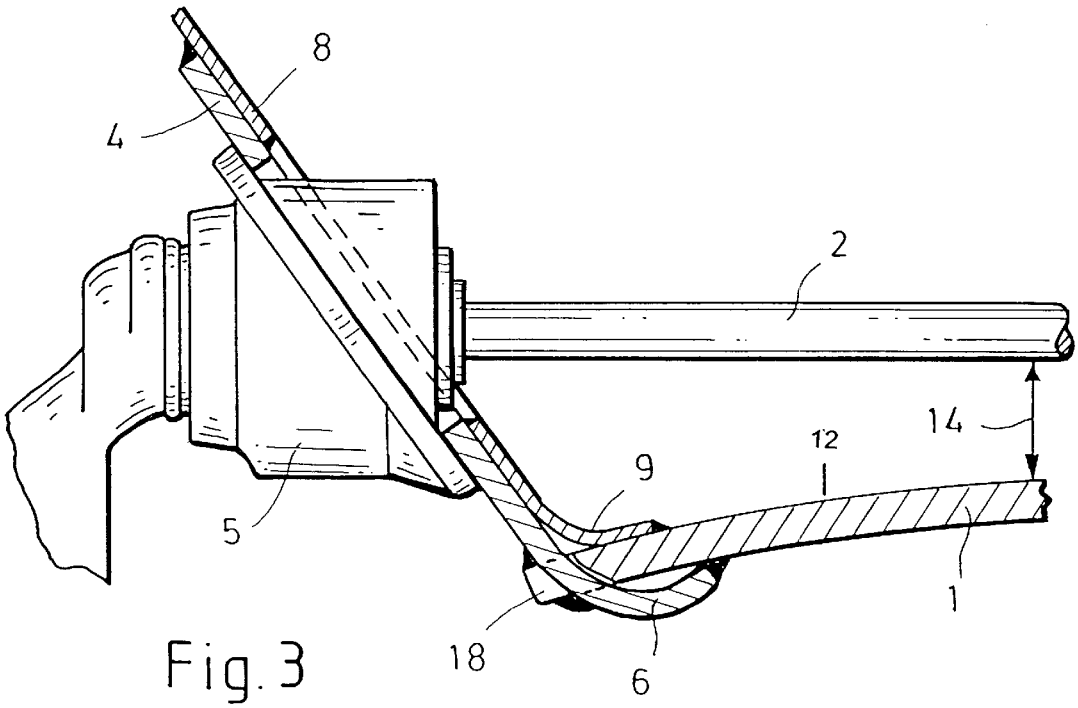
Fig. 3

ANTI-MINE FLOOR FOR AN ARMORED VEHICLE

CROSS REFERENCE TO RELATED APPLCIATION

This application claims the priority of German Patent Application No. 101 34 394.9 filed Jul. 14, 2001, which is incorporated herein by reference.

BACKGROUND OF THE INVENTION

The invention relates to an apparatus for protecting against the effects of land mines. More particularly, the present invention relates to an apparatus for protecting the crew of an armored vehicle, and the vehicle body in general, against the effects of the explosion of mines located in or on the ground against the effects of mines using protective elements mounted to the vehicle floor.

The chassis of these vehicles typically has a smooth underbody and the highest possible clearance between the underbody and the ground, which is assured by a wheel or chain moving gear of appropriate design that allows the vehicle to travel unimpeded, even off-road.

The explosive pressure effect of a mine exploding beneath the vehicle deforms and damages the relatively large surface area of the vehicle underbody or hull floor, and can cause considerable damage inside the vehicle.

To this point, the following apparatuses and principles have been implemented in mine protection. The simplest measure is to make the hull floor thick enough to withstand a predetermined mine detonation.

Another option is to construct the hull floor plate from a multi-layer or sandwich plate that comprises different superposed materials and can withstand a predetermined mine detonation.

Finally, the floor structure can be constructed from superposed plates and hollow layers, such as air layers, so the uppermost plate does not bulge, or bulges very little, in the event of a predetermined mine detonation.

According to the prior art, numerous proposals for avoiding damage have been made.

It is known from German patent document number DE 3119786 to mount planar armored elements to the vehicle underside for anti-mine protection.

In German patent document number DE 19631715, the vehicle floor is equipped with a deflector that is wedge-shaped relative to the floor. The deflector can also be provided with a gas generator for internal protection and to counteract the explosion.

In German patent document number DE 19653283, a cabin is suspended, as the crew compartment, elastically and separately in the vehicle housing for also eliminating shock effects acting externally on the vehicle that could affect the vehicle passengers.

In further applications, deformation bodies are mounted to the vehicle floor for reducing the pressure effect of mines on the vehicle.

In German patent document number DE 19941928, damping elements that are intended to reduce and absorb the mine effect are provided in an intermediate floor beneath the vehicle.

SUMMARY OF THE INVENTION

It is the object of the invention to provide a generic protection system to ensure sufficient protection for the crew of an armored vehicle, with the system possessing a simple, robust design.

This object generally is accomplished according to the present invention by an apparatus for protecting the crew of an armored vehicle against the effects of mines, comprising a concave, homogeneous protective floor plate having a large radius, and means connecting the floor plate to at least an outer hull of the vehicle to form the vehicle floor and the mine protection for the vehicle, with the center of the circle with the large radius being located beneath the floor plate.

In accordance with the invention, the hull floor beneath the vehicle is produced from a concave preferably sandwich type plate having a suitable thickness and a suitable surface weight to provide and maintain a required ground clearance. Structures that are built in above the hull, such as the spring bars of a running gear suspension, are installed such that a dynamic bulge in the floor plate caused by a mine explosion would not reach these bars, and therefore would cause no damage. The side flange plate for receiving the support-arm bearing housings for the vehicle drive are additionally provided as a support element, and for increasing the stability of the vehicle floor, in the form of an angled sheet that extends beneath the sandwich floor plate. The advantages of the embodiment of the vehicle floor in accordance with the invention lie in the savings of space and weight. Damages inflicted by a mine detonation are more easily remedied. The side flange plates stabilize the vehicle floor and increase the strength of the overall floor construction. Further advantages ensue from the discussion below.

Exemplary embodiments of the invention are schematically illustrated in the drawings and described in detail below.

BRIEF DESCRIPTION OF THE DRAWINGS

FIG. 2 is a detail view of the side view of the flange plate.

FIG. 3 is a detail view of a connection between a flange plate and the floor plate, in a cross-section.

DESCRIPTION OF THE PREFERRED EMBODIMENTS

Figure 1:
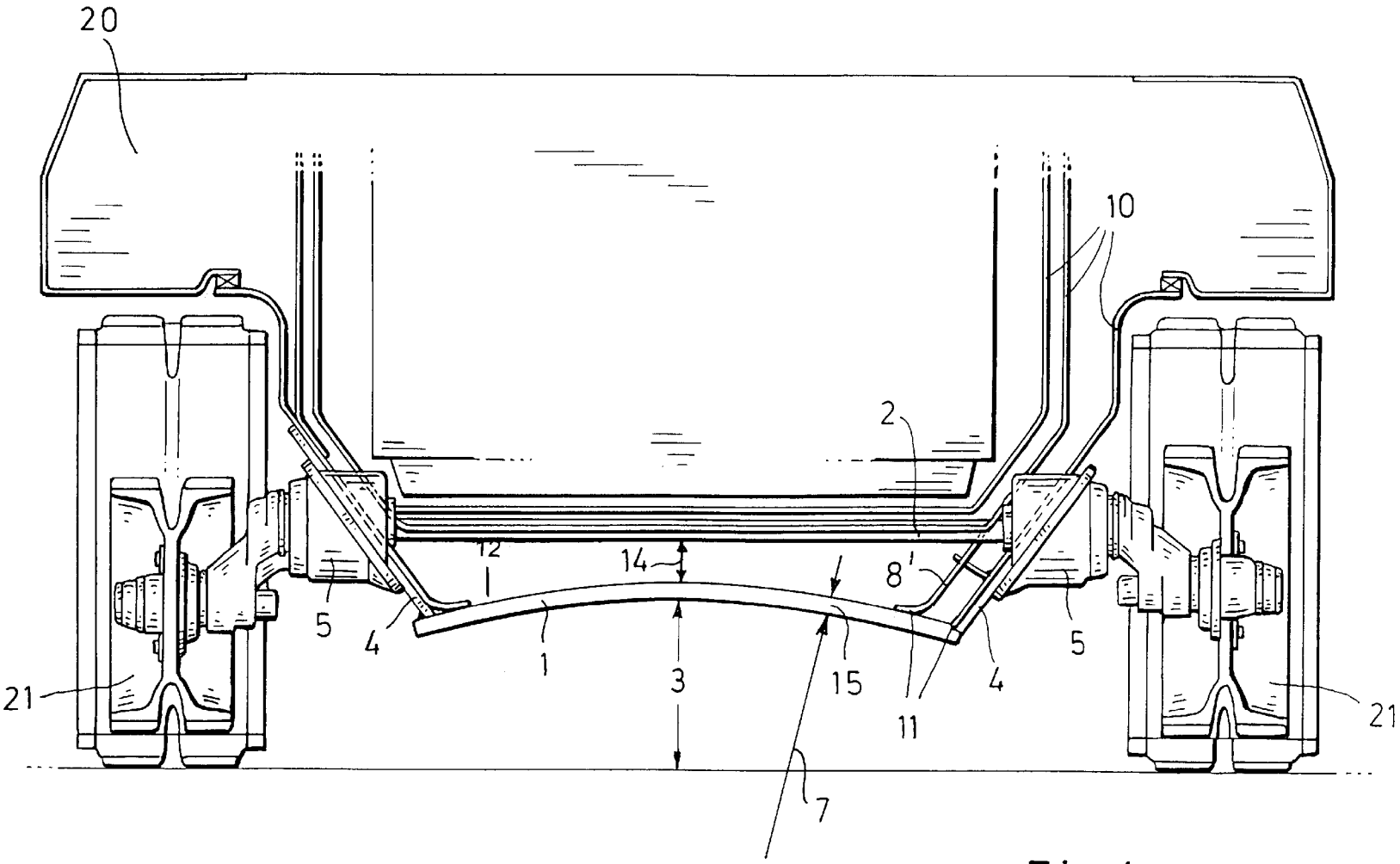
FIG. 1 is a cross-section of a vehicle having floor protection according to the invention.

The armored vehicle 20 shown in a cross-section in FIG. 1 has a running gear 21 and is provided on its underside as a vehicle floor with a concave plate 1 of a thickness 15. The plate 1 extends over the entire underside of the vehicle and is connected on the left and right side edges to the respective side flange plates 4. The concave embodiment of the floor plate 1 is expressed as a radius 7 of a circle whose center is beneath the vehicle and preferably is below the ground surface on which the vehicle stands or rests. With respect to the running gear 21, the structure of the floor plate 1 and flange plates 4 is provided for creating a clearance 3 between the plate 1 and the ground. Spring bars or support arms 2 for the running gear suspension are located at a distance 14 from the floor plate 1, and extend transversely through the floor space, starting from the support-arm bearing housings 5 which are fastened to the flange plate 4.

FIG. 2 shows one of the side flange plate 4 with a receiving bore 16 for the carrier-arm bearing housing 5, and a welded connection 17 to the floor plate 1.

Figure 4:
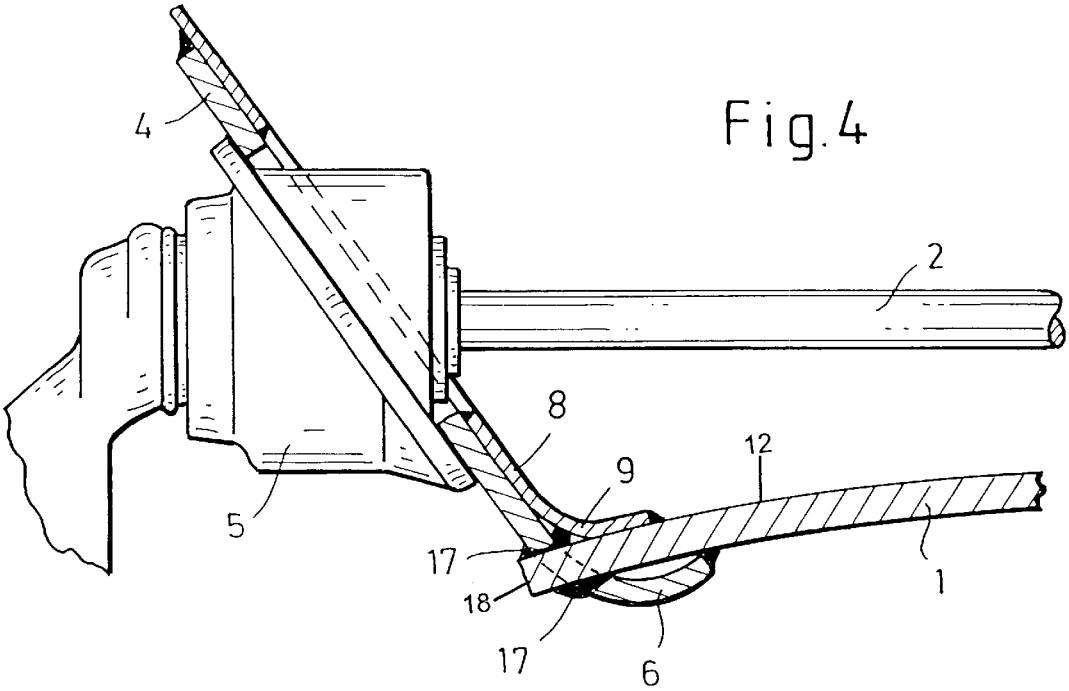
FIG. 4 is another detail view of a connection between a flange plate and the floor plate, in a cross-section.
Figure 5:
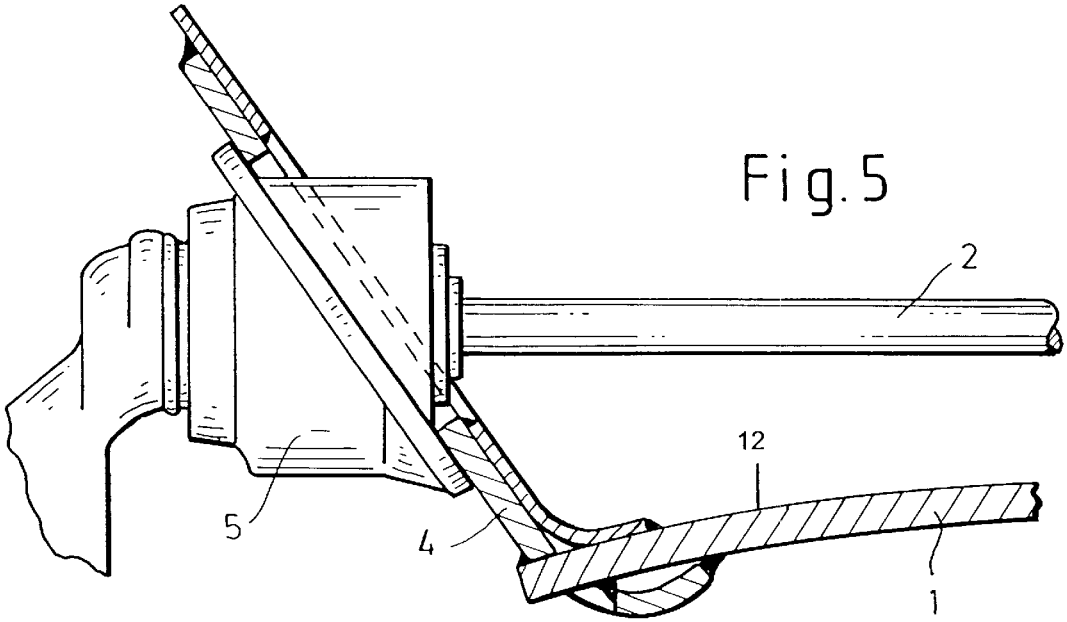
FIG. 5 is a further detail view of a connection between a flange plate and the floor plate, in a cross-section.

FIGS. 3, 4 and 5 are detailed views of the connection between the flange plate 4 and the floor plate 1.

The outer hull side wall 8 preferably is angled and bent inwardly at its lower region 9 which is welded to the upper or inner surface 12 of the floor plate 1. The flange plate 4 is likewise angled or inwardly curved in its lower region 6, and is welded to the floor plate 1. The angled flange plate 4 receives the support-arm bearing housing 5 with the spring bar or support arm 2. A distance 14 exists between the support arm 2 and the floor plate 1. This distance is sufficient to prevent damage to the support arm 2 in the event of a dynamic bulge in the floor plate as a result of a mine explosion beneath the vehicle.

The inwardly directed angled region 6 of the flange plates 4 surround the left and right side edges of the floor plate 1 and are welded to the bottom or outer surface floor plate and thus tend to support the floor plate 1. The inwardly directed angled regions of the hull side wall 8 preferably extend over the upper or inner surface of the floor plate 1 and are welded to the floor plate. If the hull side wall has a double or multi wall construction 10, then while both side walls preferably are connected to the floor plate 1 by welds 11, only the lower end of the inner wall 8' need be provided with the inwardly directed lower end which is connected to the upper surface 12 of the floor plate 1 by welding.

The connection between the lower ends of the flange plates 4 and the floor plate 1 may take many forms. Preferably, as shown, at least one side edge of the floor plate 1 is provided with a plurality of grooves and the tongues 18 formed between the grooves extend through corresponding slots 19 in the slide plates, in a type of toothing or tongue and groove arrangement, as can be seen in FIGS. 2–5, and are welded to the plates 4 at a number of locations. With this arrangement and with the addition of the angled regions 6, the floor plate 1 is strongly supported on the vehicle. However, it should be noted that other types of connections between the side flanges 4 and the floor plate 1 may be utilized. For example, a simple welding connection or a standard tongue and groove arrangement, with or without the angles regions 6 on the flange plates 4 may be utilized.

The invention now being fully described, it will be apparent to one of ordinary skill in the art that many changes and modifications can be made thereto without departing from the spirit or scope of the invention as set forth herein.

What is claimed is:

1. An apparatus for protecting the crew of an armored vehicle against the effects of land mines, comprising a concave, homogeneous protective floor plate having a radius that is large relative to a ground clearance below the plate, and means connecting the floor plate to at least an outer hull of the vehicle to form a vehicle floor and mine protection for the vehicle, with a center of the circle of the radius being located beneath the floor plate; and wherein: built-in parts are mounted in the hull above the protective floor plate, and a clear distance from the floor plate to the built-in parts is such as to permit the built-in parts to remain undamaged in the event of a mine detonation beneath the vehicle and the creation of a dynamic bulge in the floor plate.

2. An apparatus according to claim 1, wherein the center of the circle of the radius is located beneath the ground surface on which the vehicle rests.

3. The apparatus according to claim 1, wherein the means for mounting includes side flange plates connected to the outer hull and receiving carrier-arm bearing housings, with the side flanges extending downwardly and being connected to the floor plate at side edges of the floor plate.

4. The apparatus according to claim 3, wherein a lower edge of the flange plate is inwardly curved and extends around an adjacent edge of the floor plate and is welded to an outer surface of the floor plate.

5. The apparatus according to claim 4, wherein the lower edges of the side flange plates are connected to the floor plate by a toothing arrangement, and are welded to the floor plate.

6. The apparatus according to claim 3, wherein the lower edges of the side flange plates and the floor plate mesh in a tongue-and-groove arrangement, and are welded together.

7. The apparatus according to claim 6, wherein a lower edge of the flange plate is inwardly curved and extends around an adjacent edge of and beneath the floor plate and is welded to an outer surface of the floor plate.

8. The apparatus according to claim 1, wherein an outer hull side wall of the vehicle extends to the floor plate, and said means for connecting connects the outer hull side wall to the floor plate by one of welded connections, a welded toothing, or a welded tongue-and-groove connection.

9. The apparatus according to claim 8, wherein a lower end of the hull side wall has an inwardly directed region that is connected to an upper surface of the floor plate.

10. An apparatus for protecting the crew of an armored vehicle against the effects of land mines, comprising a concave, homogeneous protective floor plate having a radius that is large relative to a ground clearance below the plate, and means connecting the floor plate to at least an outer hull of the vehicle to form a vehicle floor and mine protection for the vehicle, with a center of a circle of the radius being located beneath the floor plate; and wherein the vehicle hull has an inner side wall to form a double side wall, and the inner side wall is likewise fixedly connected to the floor plate through an angled inwardly directed lower end that is welded to an upper surface of the floor plate.

11. The apparatus according to claim 10 wherein: built-in parts are mounted in the hull above the protective floor plate, and a clear distance from the floor plate to the built-in parts is such as to permit the built-in parts to remain undamaged in the event of a mine detonation beneath the vehicle and the creation of a dynamic bulge in the floor plate.

12. The apparatus according to claim 11, wherein the protective floor plate has a multi-layered structure of superposed different material layers.

13. An apparatus for protecting the crew of an armored vehicle against the effects of land mines, comprising a concave, homogeneous protective floor plate having a radius that is large relative to a ground clearance below the plate, and means connecting the floor plate to at least an outer hull of the vehicle to form a vehicle floor and mine protection for the vehicle, with a center of a circle of the radius being located beneath the floor plate; and wherein: the means for mounting includes side flange plates connected to the outer hull and receiving carrier-arm bearing housings, with the side flanges extending downwardly and being connected to the floor plate at side edges of the floor plate; and a lower edge of the flange plate is inwardly curved and extends around an adjacent edge of the floor plate and is welded to an outer surface of the floor plate.

14. The apparatus according to claim 13, wherein the lower edges of the side flange plates are connected to the floor plate by a toothing arrangement, and are welded to the floor plate.

15. An apparatus for protecting the crew of an armored vehicle against the effects of land mines, comprising a concave, homogeneous protective floor plate having a radius that is large relative to a ground clearance below the plate, and means connecting the floor plate to at least an outer hull of the vehicle to form a vehicle floor and mine protection for the vehicle, with a center of a circle of the radius being located beneath the floor plate; and wherein: the means for mounting includes side flange plates connected to the outer hull and receiving carrier-arm bearing housings, with the side flanges extending downwardly and being connected to the floor plate at side edges of the floor plate; and the lower edges of the side flange plates and the floor plate mesh in a tongue-and-groove arrangement, and are welded together.

16. The apparatus according to claim 15, wherein a lower edge of the flange plate is inwardly curved and extends around an adjacent edge of and beneath the floor plate and is welded to an outer surface of the floor plate.

* * * * *